US005647715A

United States Patent [19]

Stolz

[11] Patent Number: 5,647,715

[45] Date of Patent: Jul. 15, 1997

[54] METHOD OF ATTACHING A COVER TO THE SPINE OF A BOOK BLOCK FORMED OF BOUND PRINTED SHEETS

[75] Inventor: Marcel Stolz, Felben, Switzerland

[73] Assignee: Grapha-Holding AG, Hergiswil, Switzerland

[21] Appl. No.: 612,402

[22] Filed: Mar. 4, 1996

[30] Foreign Application Priority Data

Mar. 16, 1995 [CH] Switzerland ..... 00745/95

[51] Int. Cl.[6] ..... B42C 11/00

[52] U.S. Cl. ..... 412/1; 412/4; 412/19

[58] Field of Search ..... 412/1, 4, 5, 8, 412/9, 18, 19, 22, 24

[56] References Cited

U.S. PATENT DOCUMENTS

| | | | |
|---|---|---|---|
| 4,505,629 | 3/1985 | Lynch | 412/5 |
| 5,028,193 | 7/1991 | Misicka | 412/8 |
| 5,316,425 | 5/1994 | Granshar et al. | 412/4 X |

OTHER PUBLICATIONS

Furler, Alfred, "Perfect Binding Technology", 1971, pp. 200–211.

*Primary Examiner*—Willmon Fridie, Jr.
*Attorney, Agent, or Firm*—Spencer & Frank

[57] ABSTRACT

A method is provided for attaching a cover sheet by adhesive bonding to a spine of a book block formed of bound printed sheets, wherein after a binding process a plurality of such book blocks follow one another on a transport path at regular distances. The book blocks are arranged to be in a transverse position on the transport path. The cover sheets are clamped so that each cover sheet presents a spine portion and preformed cover side portions extending from the spine portion so that the cover side portions are freed of deformation after the spine portion of the cover sheet has been pressed to the spine of the book block. The book blocks are fed, respectively, an inner side of a clamped cover sheet oriented for adhesive bonding, facing the spine of the book block. The inner side of the cover sheet is pressed to the spine of the book block and to lateral flanks of the spine of the book block.

14 Claims, 2 Drawing Sheets

METHOD OF ATTACHING A COVER TO THE SPINE OF A BOOK BLOCK FORMED OF BOUND PRINTED SHEETS

CROSS-REFERENCE TO RELATED APPLICATION

This application claims the priority of Patent Application Serial No. 00 745/95-4 filed in Switzerland on Mar. 16, 1995, the subject matter of which is incorporated herein by reference.

BACKGROUND OF THE INVENTION

The invention relates to a method of attaching a cover sheet by adhesive bonding to the spine of a book block formed of bound printed sheets in the production of books, brochures, and similar products.

In a known method of this type, after the binding process, book blocks, which are following one another on a transport path at regular distances, are respectively fed the inner side of the cover sheet which is oriented for adhesive bonding, facing the spine of the book block. The inner side of the cover sheet is subsequently pressed to the spine of the book block as well as to the lateral flanks of the spine of the book block.

During perfect binding, the printed sheets which were gathered to form book blocks, provided with or without endpaper, are supplied to a circulating transport apparatus of a perfect binder having spaced collet chucks. In the clamped or pressed-together state, the book blocks then normally pass through various processing stations in which they are milled, notched, cleaned and glued at the spine. The attachment of endpapers may also take place once the completed book blocks are available. An equivalent state can also be accomplished with printed sheets that were thread-stitched to form book blocks.

The bound book blocks then pass through a cover feeder station where a cover that is made to fit the spine is supplied to the book block. In a known principle, the planar covers are made available during this process while standing upright in a magazine and they are pulled out of the magazine individually in an upward direction. Oriented horizontally, the covers reach the casing-in station from underneath via a groove unit. In the casing-in station, the book block provided with adhesive on its spine and laterally of the spine is bound by way of the adhesive to the inner side of the cover. Afterwards, the side portions of the cover are placed in a lateral upward position and are pressed to the narrow spine flanks in the pressing station which follows. For the reliable bonding of the covers to the cased-in book blocks, a special, effective pressing is required. To this end, a pressing pressure must be applied on both sides, and, at the same time, the spine portion of the cover must be pressed against the spine of the book block, this being disclosed in, for example, "Perfect Binding Technology" ["Technologie der Klebebindung"]by Alfred Furler, 1971.

Only after a subsequent drying step are the roughs of the books trimmed along the edges.

These known feeder stations are constructed in a complex manner and they are not suitable for higher throughput rates.

SUMMARY OF THE INVENTION

It is an object of the invention to provide a method of attaching covers to the spines of book blocks, which can be carried out in a simple manner at production outputs that are considerably higher than before and which ensures high production quality and reliability.

The above and other objects are accomplished according to the invention in that the book blocks are arranged so as to be in a transverse position on the transport path and the clamped-in cover sheets have preformed cover side portions which are freed of deformation after the spine portion has been pressed to the spine of the book block.

These and other features and advantages of the invention will be further understood from the following detailed description of the preferred embodiments with reference to the accompanying drawing, to which express reference is made regarding all details of the invention that are not mentioned specifically in the description.

DETAILED DESCRIPTION OF THE PREFERRED EMBODIMENTS

Figure 1:
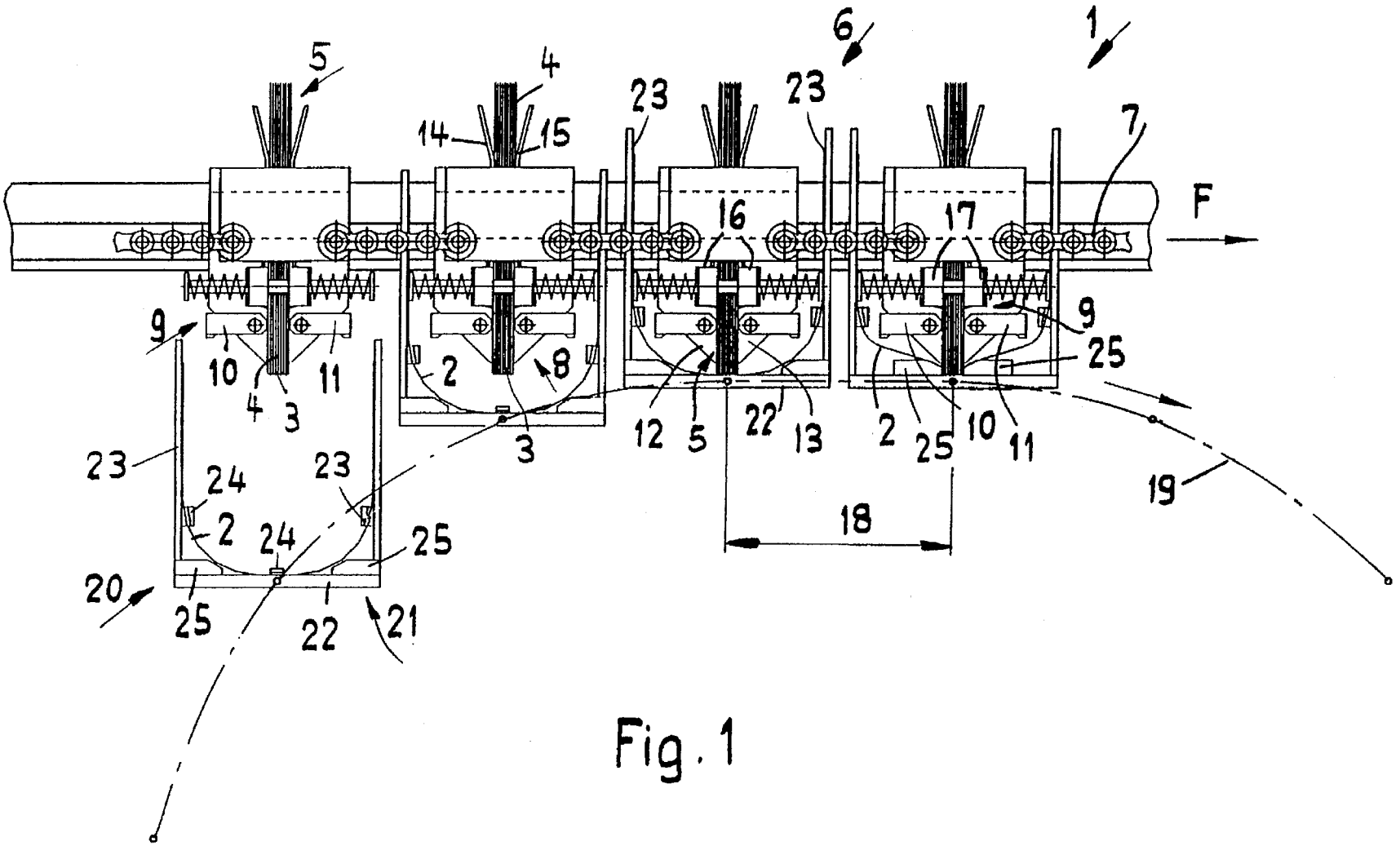
FIG. 1 schematically shows an arrangement for attaching a cover sheet to the spine of a book block according to one embodiment of the method of the invention.
Figure 2:
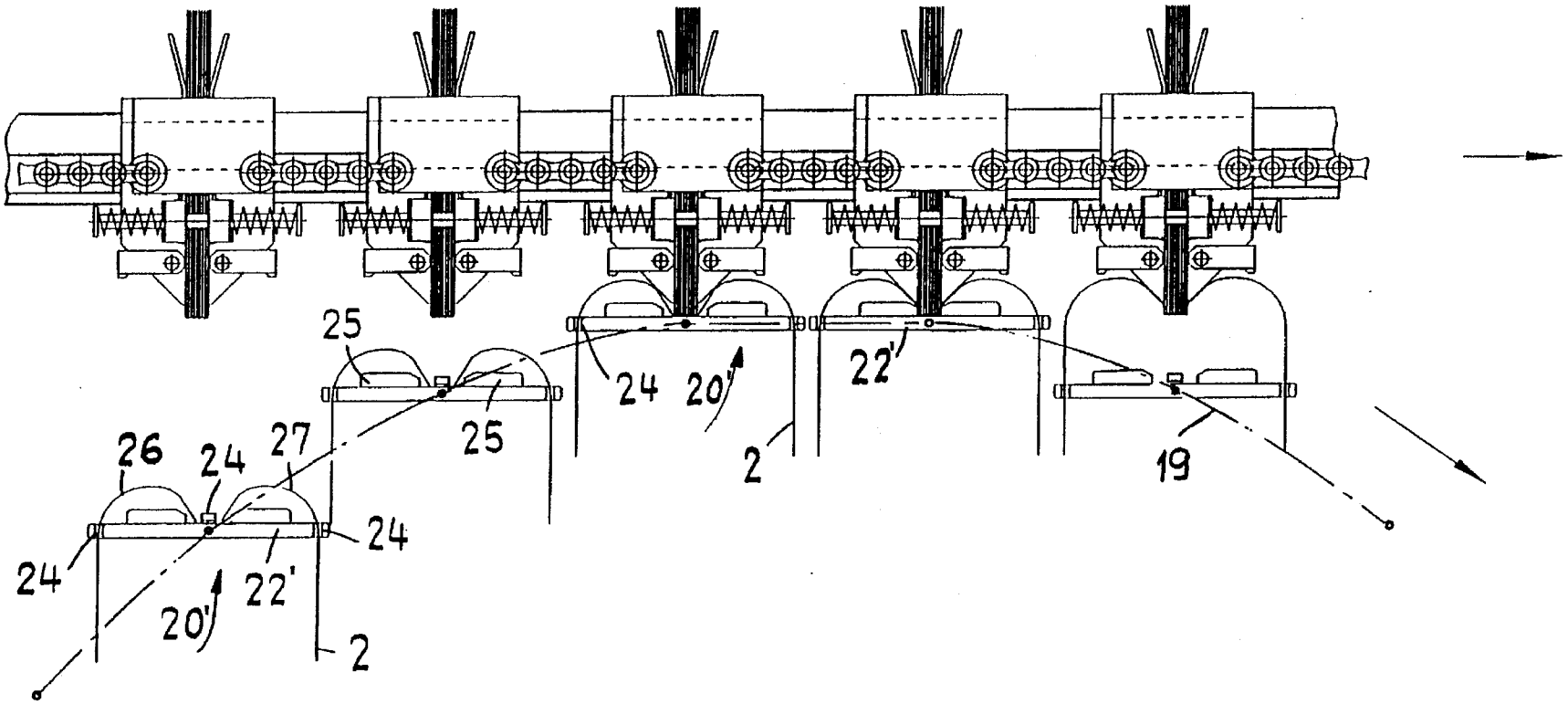
FIG. 2 shows schematically shows an alternative embodiment of the arrangement.

FIGS. 1 and 2 are partial views of an endlessly circulating transport apparatus 6 of a perfect binder which is allocated to the present arrangement 1 for attaching cover sheets 2 to spines 3 of book blocks 5 formed of adhesively bound printed sheets 4. Endlessly circulating transport apparatus 6, shown downstream of an end of the processing stations (not shown), is provided with collet chucks 8 attached on both sides to a pulling means, herein comprising a chain 7. The adhesively bound book blocks 5 are held so as to be hanging in collet chucks 8, with adhesive-bound spines 3 of the book blocks being freestanding with respect to collet chucks 8 due to the fact that the clamping jaws 10, 11 are pivoted back. Each collet chuck 8 is provided with two supports 12, 13 extending transversely to the direction of conveyance F. The distance between supports 12 and 13 in the direction of conveyance F can be adjusted such that, respectively, their inner sides approximately rest against walls 14, 15 of a holding device 9. The holding device 9, which is responsible for the transfer of the gathered printed sheets 4 from a gathering device into the collet chucks 8 of the transport apparatus 6, is positioned in the supports 12, 13 by means of transverse supports 17 penetrating into grooves 16 so as not to be displaceable in a lateral direction.

The pressing of cover sheets 2 to spines 3 of the book blocks, which will be explained below, can be effected against the clamping force exerted on the book blocks, which force is generated by the holding device 9, or by the friction this force produces when supports 12, 13 of transport apparatus 6 are pressed together against the book blocks. Holding device 9, positioned between supports 12, 13, with clamping jaws 10, 11 closed, forms a reference position of the blocks of printed sheets which were previously processed in the perfect binder. As shown, the reference position presents a specific, relatively small overhang of the blocks of printed sheets. The clamping jaws 10, 11 are operated by means of a controllable plunger arrangement (not shown), but which is described in detail along with the configuration of holding device 9 and of the transport apparatus 6 of the perfect binder, in Swiss Patent Application No. 3479/94 and its U.S. counterpart, U.S. patent application Ser. No. 08/556,008, filed Nov. 13, 1995, the disclosure of which is incorporated herein by reference. A controllable opening and closing mechanism is required for transferring the blocks of printed sheets into the collet chucks 8.

The attachment of a cover or cover sheet 2 to the spine of a book block 5 takes place on a segment embodied as a pressing section 18 downstream of the gluing station of a perfect binder. Here, the prepared book block 5 may already have been provided with the necessary adhesive on its spine 3 and on the laterally angled flanks by means of lateral adhesive application, or the necessary adhesive is supplied to the cover sheet 2 in a preparation phase.

According to the embodiment of FIG. 1, it must be assumed that adhesive was already applied to the spine 3 of the book block and the adjacent lateral flanks, or that the cover sheet 2 is coated with adhesive on the inside portion facing the spine 3.

Cover sheets 2 are respectively preformed in pressing arrangements 20, which are secured to a circulating pulling element 19 so as to be spaced apart. The cover sheets are inserted in pressing arrangements 20 and held, here in the shape of a U. For this purpose, each pressing arrangement 20 is provided with a frame 21 comprised of a holder 22 connected to pulling element 19, and two ribs 23 which are spaced in the direction of movement of the collet chucks 8 and attached to holder 22. The legs of each preformed cover sheet 2 rest against ribs 23, respectively, and the curved portion of the cover sheet rests against holder 22. Clamping elements 24 are provided on frame 21 to ensure that, after placement into pressing arrangement 20, cover sheet 2 does not change its position on the path to book block 5.

FIG. 1 illustrates the pressing process by way of four pressing arrangements 20 that are attached to pulling element 19. During this process, pressing arrangements 20 move into the gaps formed by collet chucks 8 of perfect binder. Holder 22, including inserted cover sheet 2, approaches spine 3 of book block 5. As soon as pressing section 18 is reached, pressing arrangement 20 is pressed against spine 3 of the book block with the aid of an action force.

Disposed opposite one another on holder 22 are pressing elements 25 which are driven toward one another on a guide arrangement connected with frame 21 against the flanks of spine 3 of the book block which has been placed in position such that the side portions of the cover sheet 2 are partially lifted and glued to the narrow flanks of spine 3.

Advantageously, pressing elements 25 remain in this position approximately until the time when pressing arrangement 20 leaves pressing section 18.

At pressing section 18, the speed of the pulling element 19 corresponds to the speed of the moving collet chucks 8 of the perfect binder in the same direction F.

The embodiment according to FIG. 2 differs from the embodiment in FIG. 1 with respect to the configuration of the pressing arrangements. Components in FIG. 2 corresponding to those in FIG. 1 are given like reference numerals. Cover sheets 2 are held by clamping elements 24 at holder 22' of pressing arrangement 20' at the top and bottom edges of the portion of the cover sheet 2 that will form the spine of the book. Cover sheets 2 each present segments or legs 26, 27 forming side portions of the cover which are bent backwards through clamping elements 24 in a direction facing away from the transport apparatus. Pressing elements 25 are arranged on holder 22' so that they can be driven toward one another according to the principle described with respect to FIG. 1.

It will be understood that the above description of the present invention is susceptible to various modifications, changes and adaptations, and the same are intended to be comprehended within the meaning and range of equivalents of the appended claims.

What is claimed is:

1. A method of attaching a cover sheet by adhesive bonding to a spine of a book block formed of bound printed sheets, wherein after a binding process a plurality of such book blocks follow one another on a transport path at regular distances, the method comprising steps of:

arranging the book blocks to be in a transverse position on the transport path;

clamping respective cover sheets so that each cover sheet presents a spine portion and preformed cover side portions extending from the spine portion so that the cover side portions are freed of deformation after the spine portion of the cover sheet has been pressed to the spine of the book block;

feeding each book block an inner side of a clamped cover sheet oriented for adhesive bonding, facing the spine of the book block; and pressing the inner side of the cover sheet to the spine of the book block and to lateral flanks of the spine of the book block.

2. A method according to claim 1, wherein the clamping step includes clamping the respective cover sheets at the spine portion.

3. A method according to claim 1, wherein the clamping step includes clamping the side portions of the cover sheet to form legs which are curved so as to approximately form a U-shape having an inner side facing the spine of the book block.

4. A method according to claim 1, wherein the clamping step includes clamping the side portions, respectively, of the cover sheet, so that each side portion has a curved elevation starting from the spine portion and is bent backwards away from the spine of the book block.

5. A method according to claim 1, wherein the book blocks are transported on the transport path with a cadence and the feeding step includes feeding the cover sheets on a conveyor path approaching the transport path of the book blocks in a cadence corresponding to the cadence of the book blocks on the transport path.

6. A method according to claim 1, further including providing the spines of the book blocks and adjoining flanks with a strip-shaped adhesive application.

7. A method according to claim 1, further including providing a portion of the cover sheets to be attached to spines of the book blocks and adjoining flanks with a strip-shaped adhesive application.

8. An arrangement for attaching a cover sheet to a spine of a book block formed of bound printed sheets, comprising:

a transport apparatus, having a transport direction, for conveying book blocks arranged transverse to the transport direction with a cadence in the transport direction; and a conveying apparatus forming with the transport apparatus a pressing section and feeding the cover sheets to the pressing section in the cadence of the transport apparatus, the conveying apparatus including a circulating pulling means and pressing devices secured at regular distances to the circulating pulling means, the pressing devices each including clamping means for clamping a cover sheet into a preformed shape so that an inner side of the clamped-in cover sheet faces the spine of the book block in the pressing section and pressing elements which can be advanced against flanks bordering the spine of the book block in the pressing section.

9. An arrangement according to claim 8, wherein the clamping means is for clamping the cover sheet in place in the pressing device so the cover sheet presents a spine portion facing the spine of the book block in the pressing section and outer side portions that extend from the spine portion and are bent backwards away from the spine of the book block.

10. An arrangement according to claim 8, wherein the pressing devices each include a frame extending approximately parallel to the direction of movement of the book blocks in the pressing section.

11. An arrangement according to claim 10, wherein each pressing device includes a guide arrangement connected with the frame on which the pressing elements are driven counter to one another.

12. An arrangement according to claim 8, wherein the clamping means is for clamping the cover sheet into the pressing device in the form of a U-shape with the open side of the U-shape facing the spine of the book block.

13. An arrangement according to claim 12, wherein the pressing devices each comprise a frame including a horizontal holder and two ribs spaced apart in the direction of the transport path extending upwardly from the holder, and the U-shaped cover sheet has legs held in a curved position by the ribs of the frame.

14. An arrangement according to claim 8, wherein the transport apparatus constitutes part of a perfect binding arrangement and includes a pulling means and collet chucks secured to the pulling means, the collet chucks each including two clamping jaws for pressing a respective book block together.

* * * * *